United States Patent [19]

Filip

[11] Patent Number: 4,939,882

[45] Date of Patent: Jul. 10, 1990

[54] PREFABRICATED PYRAMID-SHAPED STRUCTURAL MEMBERS FOR THREE-DIMENSIONAL FRAMEWORKS

[75] Inventor: Octavian Filip, Wurzburg, Fed. Rep. of Germany

[73] Assignee: Mero-Raumstruktur GmbH & Co., Fed. Rep. of Germany

[21] Appl. No.: 230,354

[22] Filed: Aug. 10, 1988

[51] Int. Cl.[5] ..... E04H 12/00

[52] U.S. Cl. ..... 52/648; 52/646

[58] Field of Search ..... 52/641, 646, 648; 403/170, 171, 174, 217, 219, 270, 271

[56] References Cited

U.S. PATENT DOCUMENTS

| | | | |
|---|---|---|---|
| 4,070,847 | 1/1978 | Madl | 403/171 X |
| 4,562,682 | 1/1986 | Arvedi | 52/648 |
| 4,679,372 | 7/1987 | Noble | 52/648 |
| 4,763,459 | 8/1988 | Wesselski | 52/648 X |

FOREIGN PATENT DOCUMENTS

| | | | |
|---|---|---|---|
| 2457674 | 10/1976 | Fed. Rep. of Germany | 403/217 |
| 2727495 | 6/1977 | Fed. Rep. of Germany . | |
| 2917422 | 4/1979 | Fed. Rep. of Germany . | |
| 3133946 | 8/1981 | Fed. Rep. of Germany . | |
| 3123482 | 12/1982 | Fed. Rep. of Germany | 52/648 |
| 1280634 | 11/1961 | France | 52/648 |
| 1547926 | 12/1967 | France . | |
| 1581815 | 9/1969 | France | 52/648 |
| 528374 | 9/1976 | U.S.S.R. | 403/217 |
| 1244064 | 8/1969 | United Kingdom . | |

*Primary Examiner*—David A. Scherbel
*Assistant Examiner*—Jerrold D. Johnson
*Attorney, Agent, or Firm*—Frank P. Presta

[57] ABSTRACT

In prefabricated pyramid-shaped structural members for the production of two-part grill frameworks, the diagonally running rods of each pyramid-shaped structural member are welded with their ends on a cover plate, which has a borehole for the passage of a fastening screw for a head member. Each head member includes a contact surface for the cover plate and is provided with a tapped borehole to receive the fastening screw, which connects the relevant joint member in each case with the cover plate. This screw connection is advantageously not undertaken until at the point of assembly of the grill framework.

4 Claims, 2 Drawing Sheets

PREFABRICATED PYRAMID-SHAPED STRUCTURAL MEMBERS FOR THREE-DIMENSIONAL FRAMEWORKS

BACKGROUND OF THE INVENTION

The present invention relates to prefabricated pyramid-shaped structural members for three-dimensional structural members, the frameworks consisting of rod members connected with each other at their base, the rod members being for instance profile bars, and of which diagonally running rods extend toward the vertex of each structural member, which are connected with a joint member, wherein each joint member includes a plurality of tapped boreholes for the screw connection of other rods of the total three-dimensional framework.

It is known to manufacture such pyramid-shaped structural members in the form of prefabricated structures and to join them together at the building construction site in connection with additional rods, forming a three-dimensional checkerwork grilling in two layers. Such checkerwork grills, for instance, may form supporting structures for roofs used for various purposes. Until this time, when these three-dimensional structural members have been used, the ends of the diagonally running rods have been connected at the vertex of the pyramid-shaped members by means of weld connections formed with joint members. This methods, however, has the drawback that the pyramid-shaped structural members and the joint members cannot be produced independent of each other but must be single integral members, although their separateness would be very desirable from the point of view of manufacturing technology.

As a result of these conditions, until this time it has been necessary for instance for the surface treatment, including the treatment of the hot galvanizing of the pyramid-shaped structural members, to go to the bother of closing off the tapped boreholes in the joint members, in order to prevent the running on and continuation of these tapped boreholes through the surface protective layer, for instance a layer of zinc. In addition to that, following the successful welding of the joint members with the ends of the diagonally running rods, an eventual, expected and still required adjustment of the axes of the tapped boreholes in the joint members which would occur during the assembly and relative to the pyramid-shaped, rod-shaped structure is no longer possible.

SUMMARY OF THE INVENTION

The object of the invention is to avoid the above problems and additionally to provide a pyramid-shaped structural member for three-dimensional frameworks of the aforementioned type of structure in such a manner that each individual joint member and the rods can be produced independent of each other and thus also each joint member and the rods can be surface treated in separate work processes. Additionally, the joint members should be able to be adjusted during the assembly relative to the pyramid-shaped structural members consisting of rods or respectively they should be able to be rotated, in order to facilitate the possibility of their connection on many sides with more rods, either additional rods of the same three-dimensional framework or else for instance also the parts of support framework structures or the like.

According to the invention, the above object is attained in that the diagonal rods may be welded with their ends at the vertices of the pyramid-shaped structural members onto a head member, which is screwed onto the joint member which has been provided with a contact surface for the head member. Therefore, the pyramid-shaped structure made up of rods can be produced with a welded-on head member separated from the joint member and therefore the members can also be surface treated independent of one another. Thus it is no longer required as in the present state of the art to close off the tapped boreholes at the points of their passage into the joint members. During assembly the joint members are screwed on the head members of the pyramid-shaped rod constructions, and the axes of the tapped boreholes, dependent upon the relevant conditions at any time, can in turn be adjusted practically as desired by rotation of the joint members relative to the pyramid-shaped rod structures. Thus the flexibility of the structural system is considerably increased for practical use. Furthermore, the possibility now exists of using various different joint members to also allow the possibility of further connections to other ribbed structures in the form of support or thrust towers or supporting walls, or a combination thereof, with roof support beams provided in the rib configuration.

In one configuration of the invention, the head member may be a circular cover plate with one or more boreholes for the passage of a fastening screw or screws.

According to another configuration of the invention, the cover plate has a central projection with quadrangular base and the ends of the diagonal rods are welded to the side surfaces of this projection and to the cover plate. This feature facilitates the manufacture of the pyramid-shaped rod construction.

One advantageous feature is that the passage borehole for the fastening screw extends through the middle projection on the cover plate.

According to still another configuration of the invention, the joint member is in the form of a hemisphere, of which the flat side forms the contact surface for the cover plate, on which is provided one or more tapped boreholes to receive the fastening screw or screws for the cover plate. Hemispherical joint members of this sort are favorable from the point of view of manufacturing technology and can be provided with a plurality of tapped boreholes for screw connections of the rods of a three-dimensional framework.

BRIEF DESCRIPTION OF THE DRAWINGS

The invention is to be explained in connection with the attached drawings of one exemplary embodiment. In the drawings.

DESCRIPTION OF THE PREFERRED EMBODIMENTS

Figure 1:
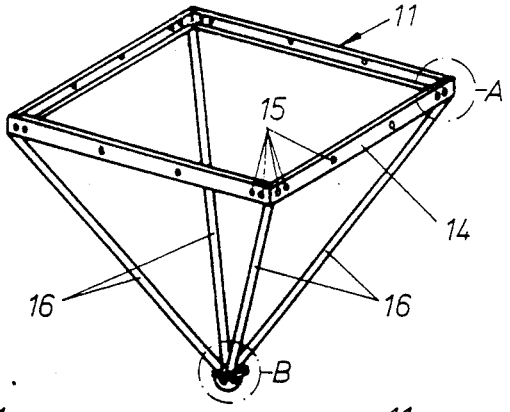
FIG. 1 is a perspective view of a pyramid-shaped structural member with a hemispherical joint member screwed on according to the present invention.
Figure 2:
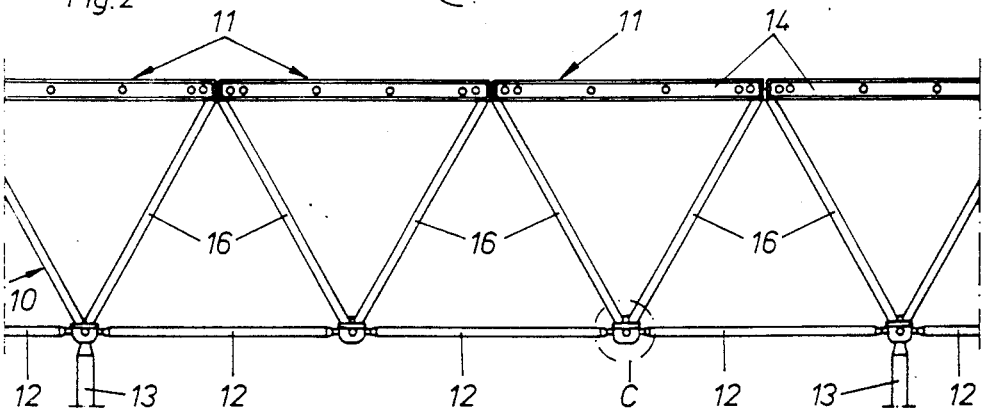
FIG. 2 is a partial side view of a three-dimensional two-layer grill checkerwork framework composed of a plurality of the pyramid-shaped structural members of FIG. 1 and additional rods.

The three-dimensional two-layer grill checkerwork framework (10) shown in FIG. 2 is composed of a plurality of pyramid-shaped structural members (11) as well as additional rods (12) in the lower chord. This grill framework (10) can be erected, for instance, with the aid of a crane on upright supports (13) and can be provided with a roof sheathing (not shown), in order for instance to form a superimposed roof over moving surfaces, railroad platforms or the like.

Each pyramid-shaped structural member (11) has a quadrangular frame of four generally C-shaped profiles (14) open to the inside, which are welded together at their ends. The frame made up of C profiles (14) makes up the upper chord of the finished grill framework (10). In the area of its lower chord, as explained above, the pyramid-shaped structural members (11) are completed and/or supplemented by inclusion of the rods (12) to form grill framework (10). C profiles (14) of structural members (11) are provided with a plurality of openings (15) passing all the way through for screws (not shown), by means of which C profiles (14) of adjacent structural members (11) are connected together at the construction site.

Figure 3:
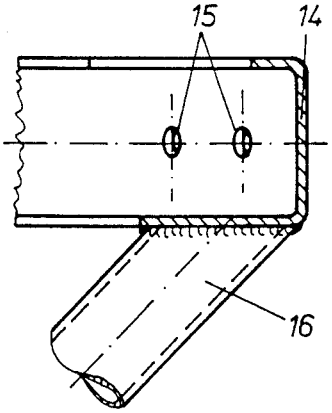
FIG. 3 is an enlarged sectional view in some detail of the area A of FIG. 1.
Figure 4:
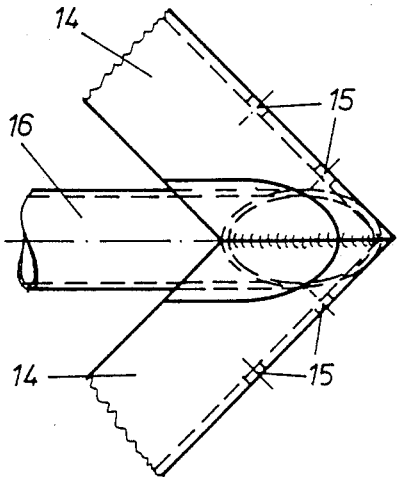
FIG. 4 is an enlarged plan view of a part of the structural member of FIG. 1 in area A.
Figure 5:
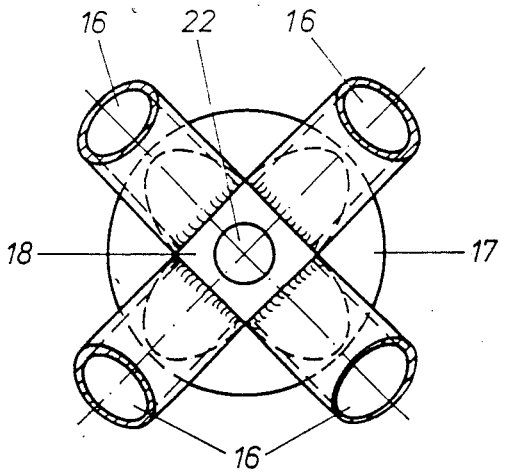
FIG. 5 is an enlarged plan view of the vertex of the pyramid-shaped structural member in area B of FIG. 1.
Figure 6:
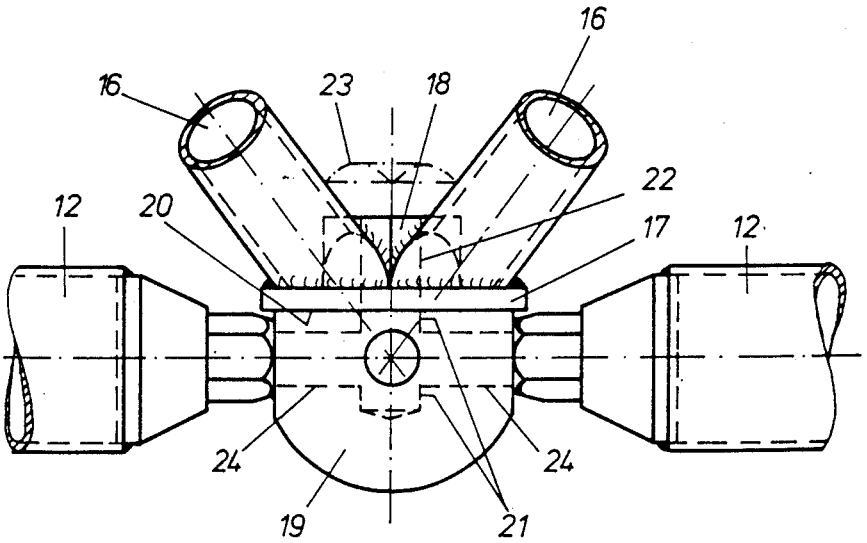
FIG. 6 is an enlarged side view of a section cut out of the three-dimensional checkerwork framework of FIG. 2 in area C.

In the exemplary embodiment, rod members (16) in the form of round section pipes are welded onto the corners of the framework of C profiles (14) (FIG. 3). The opposite ends of these rods (16) are welded onto a circular cover plate (17) as well as onto the side surfaces of a quadrangular projection (18), which is arranged in the middle of circular cover plate (17). Projection (18) can be configured as one integral piece with cover plate (17) or alternatively may be produced as a separate part and then be welded together with cover plate (17). The ends of rods (16), as shown clearly in FIGS. 3, 4 and 6, are beveled suitably for the aforementioned weld connections.

The suitable number of pyramid-shaped structures of C profiles (14), the diagonally running rods (16) and the cover plates (17) required for the production of total grill framework (10) are prefabricated and transported to the building site stacked fitted into one another to save space. At that point then hemispherical joint members (19) can be screwed on cover plates (17). Each joint member (19) has a contact surface (20) for a cover plate (17) as well as a middle tapped borehole (21) in the middle of the contact surface (20), with which is associated on the outside an opening (22) all the way through in cover plate (17) and in projection (18), for the fitting of a fastening screw (23), which can be screwed into the tapped borehole (21), in order in turn to connect a joint member (19) with cover plate (17). Fastening screw (23) is indicated in FIG. 6 in dot-dash lines.

Each hemispherical joint member (19) includes further tapped boreholes (24) for fastening screws (not shown), whereby rods (12) in the lower chord of grill framework (10) are attached to pyramid-shaped structural members (11). In this manner, the upright supports (13) can also be connected with certain joint members (19) of grill framework (10).

The roofing or sheathing (not shown) can be assembled directly on C profiles (14) in the upper chord of grill framework (10).

As a modification of the exemplary embodiment it is possible to provide additional tapped boreholes in joint members (19) for the screw connection of more rods, which members can form parts of support towers or walls or the like.

I claim:

1. Prefabricated pyramid-shaped structural member for a three-dimensional framework, comprising rods which are connected with one another, wherein the rods extend diagonally toward the vertex of each structural member and are connected to a joint member, and the joint member includes a plurality of tapped boreholes for the screw connection of rods of the three-dimensional framework, characterized in that the diagonally running rods (16) are welded with their ends at the vertex of the pyramid-shaped structural member (11) to a cover plate (17), which is screwed onto the joint member (19) provided with a contact surface (20) for the cover plate (17), the cover plate (17) has a central projection (18) with a quadrangular base, and the ends of the diagonally running rods (16) are welded to the side surfaces of said projection (18) and to the cover plate (17).

2. Structural member as in claim 1, characterized in that the cover plate (17) is circular with at least one borehole (22) all the way through for the passage of a fastening screw.

3. Structural member as in claim 2, characterized in that said borehole (22) for the fastening screw extends through the central projection (18) on the cover plate (17).

4. Structural member as in claim 2, characterized in that the joint member (19) is in the form of a hemisphere, of which the flat side forms the contact surface (20) for the cover plate (17), on which is provided at least one tapped borehole (21) to receive the fastening screw for the cover plate (17).

* * * * *